US007786060B2

(12) United States Patent
Fellows et al.

(10) Patent No.: US 7,786,060 B2
(45) Date of Patent: Aug. 31, 2010

(54) LUBRICATING OIL ADDITIVE CONCENTRATES

(75) Inventors: Raymond Fellows, Oxfordshire (GB); Ian A. W. Bell, Oxfordshire (GB)

(73) Assignee: Infineum International Limited (GB)

( * ) Notice: Subject to any disclaimer, the term of this patent is extended or adjusted under 35 U.S.C. 154(b) by 705 days.

(21) Appl. No.: 11/266,874

(22) Filed: Nov. 4, 2005

(65) Prior Publication Data

US 2006/0105925 A1 May 18, 2006

(30) Foreign Application Priority Data

Nov. 16, 2004 (EP) ..... 04257106

(51) Int. Cl.
*C10L 1/18* (2006.01)
*C10L 1/14* (2006.01)

(52) U.S. Cl. ..... 508/585; 508/542; 508/455; 508/459

(58) Field of Classification Search ..... None
See application file for complete search history.

(56) References Cited

U.S. PATENT DOCUMENTS

| | | | | |
|---|---|---|---|---|
| 5,021,173 | A | 6/1991 | Waddoups et al. | 252/35 |
| 5,141,657 | A * | 8/1992 | Fetterman et al. | 508/192 |
| 5,259,967 | A | 11/1993 | Ripple | 252/32.007 E |
| 5,616,816 | A | 4/1997 | Burjes et al. | 568/727 |
| 6,821,933 | B2 * | 11/2004 | Feustel et al. | 508/390 |
| 2003/0199399 | A1 * | 10/2003 | Hartley et al. | 508/365 |
| 2006/0025313 | A1 * | 2/2006 | Boffa | 508/199 |

FOREIGN PATENT DOCUMENTS

| | | |
|---|---|---|
| EP | 0 725 129 A2 | 8/1996 |

* cited by examiner

*Primary Examiner*—Glenn A Caldarola
*Assistant Examiner*—Vishal Vasisth

(57) ABSTRACT

Lubricating oil additive concentrates containing oil of lubricating viscosity, at least one basic metal complex, an oil-soluble hydrocarbyl phenol aldehyde condensate, and an organic friction modifier containing at least one hydroxyl and/or amino group.

10 Claims, No Drawings

LUBRICATING OIL ADDITIVE CONCENTRATES

FIELD OF THE INVENTION

The invention is directed to additive concentrates useful in the preparation of lubricating oil compositions. More specifically, preferred embodiments of the present invention provide lubricating oil additive concentrates exhibiting improved storage stability.

BACKGROUND OF THE INVENTION

Lubricating oil compositions for use in crankcase engine oils comprise a major amount of base stock oil and minor amounts of additives that improve the performance and increase the useful life of the lubricant. Crankcase lubricating oil compositions conventionally contain basic metal complexes, which act as detergents and acid neutralizers, phenolic and/or aminic antioxidants and organic friction modifiers containing at least one hydroxyl or amino group, which function as organic friction modifiers that are effective in improving fuel economy. In the face of increased demands for improved fuel economy, and further demands for reductions in the amounts of metal (ash) contained in the lubricant, formulators have used ever-increasing amounts of organic friction modifiers.

Lubricating oil additives are commonly provided to lubricant formulators in the form of 10 to 80 mass %, e.g., 20 to 80 mass % active ingredient (AI) concentrates, which are then dissolved in major amounts of oil of lubricating viscosity to provide a fully formulated lubricant. The concentrates are commonly diluted in 3 to 100, e.g., 5 to 40 parts by weight of oil of lubricating viscosity, per part by weight of the additive concentrate. As noted above, certain lubricating oil additives are known to interact with others in concentrates. One such known interaction occurs between organic friction modifiers and overbased metal detergents. Specifically, the organic friction modifiers have been found to adversely affect the complex of the metal detergents, causing the formation of sediment in the concentrate upon storage. Previously, this interaction has been minimized by selecting detergents that did not severely interact with the organic friction modifier. The addition of a polyalkenyl acylating agent has also been found to regulate this unwanted interaction. However, the detergents less likely to interact with organic friction modifiers have been found to cause gelation problems in additive packages, and the presence of polyalkenyl acylating agents (e.g., polyisobutenyl succinic anhydride (PIBSA)) has been found to negatively impact the fuel economy potential of lubricating oil compositions. Further, with the increased amounts of the organic friction modifier now required, the effect of polyalkenyl acylating agent compatibilizers and detergent selection on additive package stability has become insufficient.

As lubricating oil quality standards have become more stringent, the required amount of organic friction modifier has increased, and the presence of even minor amounts of sediment in additive concentrates has become unacceptable to lubricant formulators. Therefore, it would be advantageous to be able to provide additive concentrates containing overbased metal detergents and high levels of organic friction modifiers, in which the components do not interact to form sediment.

SUMMARY OF THE INVENTION

The present invention provides a lubricant additive concentrate comprising an admixture of at least one basic metal complex, at least 1.7 mass %, based on the mass of the condensate, of at least one organic friction modifier having at least one hydroxyl or amino group, and an oil-soluble hydrocarbyl phenol aldehyde condensate.

The oil-soluble hydrocarbyl phenol aldehyde condensate is preferably a methylene bridged alkyl phenol. The presence of the oil-soluble, hydrocarbyl phenol aldehyde condensate improves concentrate stability.

In accordance with another aspect of the present invention, there is provided a method of improving the stability of a lubricant additive concentrate comprising an admixture of at least one basic metal complex and at least one organic friction modifier having at least one hydroxyl or amino group, which method comprises adding to said concentrate a hydrocarbyl phenol aldehyde condensate. The hydrocarbyl phenol aldehyde condensate is preferably a methylene bridged alkyl phenol.

Other and further objects, advantages and features of the present invention will be understood by reference to the following specification.

DETAILED DESCRIPTION OF THE INVENTION

Organic friction modifiers useful in the practice of the invention, include oil-soluble compounds containing at least one polar group selected from hydroxyl and amine groups, which compounds are capable of reducing friction under hydrodynamic and mixed hydrodynamic/boundary layer conditions. Examples of such materials include glycerol esters of higher fatty acids, for example, glycerol monooleate; esters of long chain polycarboxylic acids with diols, for example, the butane diol ester of a dimerized unsaturated fatty acid; oxazoline compounds; and alkoxylated alkyl-substituted mono-amines, diamines and alkyl ether amines, for example, ethoxylated tallow amine and ethoxylated tallow ether amine. Particularly preferred organic friction modifiers include glycerol oleates, particularly glycerol monooleate, and ethoxylated amines, particularly ethoxylated tallow amine. Because adverse interactions are more severe when elevated levels of organic friction modifier are present in the concentrate, the concentrate of the present invention contains at least 1.7 mass %, preferably at least 3 mass %, and more preferably at least 5 mass %, of organic friction modifier, based on the total weight of the additive concentrate. In alternative terms, concentrates that contain the organic friction modifier in an amount sufficient to provide a formulated lubricant with at least 0.15 mass %, preferably, at least 0.25 mass % and more preferably at least 0.5 mass % of organic friction modifier after dilution are preferred.

Basic metal complexes useful in the context of the invention function as both detergents to reduce or remove deposits and as acid neutralizers or rust inhibitors, thereby reducing wear and corrosion and extending engine life. Detergents generally comprise a polar head with a long hydrophobic tail. The polar head comprises a metal salt of an acidic organic compound. The salts may contain a substantially stoichiometric amount of the metal in which case they are usually described as normal or neutral salts, and would typically have a total base number or TBN (as can be measured by ASTM D2896) of from 0 to 80. A large amount of a metal base may be incorporated by reacting excess metal compound (e.g., an oxide or hydroxide) with an acidic gas (e.g., carbon dioxide). The resulting overbased detergent comprises neutralized detergent as the outer layer of a metal base (e.g. carbonate) micelle. Such overbased detergents may have a TBN of 150 or greater, and typically will have a TBN of from 250 to 450 or more.

Detergents that may be used include oil-soluble neutral and overbased sulfonates, phenates, sulfurized phenates, thiophosphonates, salicylates, and naphthenates and other oil-soluble carboxylates of a metal, particularly the alkali or alkaline earth metals, e.g., barium, sodium, potassium, lithium, calcium, and magnesium. The most commonly used metals are calcium and magnesium, which may both be present in detergents used in a lubricant, and mixtures of calcium and/or magnesium with sodium. Particularly convenient metal detergents are neutral and overbased calcium sulfonates having TBN of from 20 to 450, neutral and overbased calcium phenates and sulfurized phenates having TBN of from 50 to 450 and neutral and overbased magnesium or calcium salicylates having a TBN of from 20 to 450. Combinations of detergents, whether overbased or neutral or both, may be used.

Sulfonates may be prepared from sulfonic acids which are typically obtained by the sulfonation of alkyl substituted aromatic hydrocarbons such as those obtained from the fractionation of petroleum or by the alkylation of aromatic hydrocarbons. Examples included those obtained by alkylating benzene, toluene, xylene, naphthalene, diphenyl or their halogen derivatives such as chlorobenzene, chlorotoluene and chloronaphthalene. The alkylation may be carried out in the presence of a catalyst with alkylating agents having from about 3 to more than 70 carbon atoms. The alkaryl sulfonates usually contain from about 9 to about 80 or more carbon atoms, preferably from about 16 to about 60 carbon atoms per alkyl substituted aromatic moiety.

The oil soluble sulfonates or alkaryl sulfonic acids may be neutralized with oxides, hydroxides, alkoxides, carbonates, carboxylate, sulfides, hydrosulfides, nitrates, borates and ethers of the metal. The amount of metal compound is chosen having regard to the desired TBN of the final product but typically ranges from about 100 to 220 mass % (preferably at least 125 mass %) of that stoichiometrically required.

Metal salts of phenols and sulfurized phenols are prepared by reaction with an appropriate metal compound such as an oxide or hydroxide and neutral or overbased products may be obtained by methods well known in the art. Sulfurized phenols may be prepared by reacting a phenol with sulfur or a sulfur containing compound such as hydrogen sulfide, sulfur monohalide or sulfur dihalide, to form products which are generally mixtures of compounds in which 2 or more phenols are bridged by sulfur containing bridges.

Carboxylate detergents, e.g., salicylates, can be prepared by reacting an aromatic carboxylic acid with an appropriate metal compound such as an oxide or hydroxide and neutral or overbased products may be obtained by methods well known in the art. The aromatic moiety of the aromatic carboxylic acid can contain heteroatoms, such as nitrogen and oxygen. Preferably, the moiety contains only carbon atoms; more preferably the moiety contains six or more carbon atoms; for example benzene is a preferred moiety. The aromatic carboxylic acid may contain one or more aromatic moieties, such as one or more benzene rings, either fused or connected via alkylene bridges. The carboxylic moiety may be attached directly or indirectly to the aromatic moiety. Preferably the carboxylic acid group is attached directly to a carbon atom on the aromatic moiety, such as a carbon atom on the benzene ring. More preferably, the aromatic moiety also contains a second functional group, such as a hydroxy group or a sulfonate group, which can be attached directly or indirectly to a carbon atom on the aromatic moiety.

Preferred examples of aromatic carboxylic acids are salicylic acids and sulfurized derivatives thereof, such as hydrocarbyl substituted salicylic acid and derivatives thereof. Processes for sulfurizing, for example a hydrocarbyl—substituted salicylic acid, are known to those skilled in the art. Salicylic acids are typically prepared by carboxylation, for example, by the Kolbe—Schmitt process, of phenoxides, and in that case, will generally be obtained, normally in a diluent, in admixture with uncarboxylated phenol.

Preferred substituents in oil—soluble salicylic acids are alkyl substituents. In alkyl—substituted salicylic acids, the alkyl groups advantageously contain 5 to 100, preferably 9 to 30, especially 14 to 20, carbon atoms. Where there is more than one alkyl group, the average number of carbon atoms in all of the alkyl groups is preferably at least 9 to ensure adequate oil solubility.

Detergents generally useful in the formulation of lubricating oil compositions also include "hybrid" detergents formed with mixed surfactant systems, e.g., phenate/salicylates, sulfonate/phenates, sulfonate/salicylates, and sulfonate/phenate/salicylates, as described, for example, in pending U.S. patent application Ser. Nos. 09/180,435 and 09/180,436 and U.S. Pat. Nos. 6,153,565 and 6,281,179.

Interaction with organic friction modifiers in lubricating additive concentrates is particularly severe when the metal of the metal complex is calcium. Further, the interaction with the organic friction modifier is more pronounced in concentrates containing sulfonate detergents and complex detergents containing sulfonate surfactant. Therefore, in a preferred embodiment, the basic metal complex is calcium overbased detergent or overbased sulfonate or sulfonate-containing complex detergent, more preferably overbased calcium sulfonate or sulfonate-containing complex detergent.

Oil-soluble hydrocarbyl phenol aldehyde condensates useful in the practice of the present invention are those having the following structure:

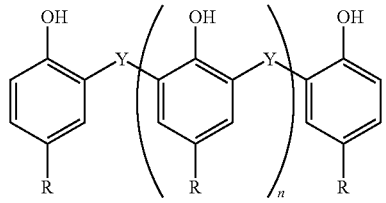

wherein n is 0 to 10, preferably 1 to 8, more preferably 2 to 7, and most preferably 3 to 6; Y is a divalent bridging group, and is preferably a hydrocarbyl group, preferably having from 1 to 4 carbon atoms; and R is a hydrocarbyl group having from 4 to 30, preferably 8 to 18, and most preferably 9 to 15 carbon atoms.

The hydrocarbyl phenol aldehyde condensate is preferably a hydrocarbyl phenol formaldehyde condensate. The term "hydrocarbyl" as used herein means that the group concerned is primarily composed of hydrogen and carbon atoms and is bonded to the remainder of the molecule via a carbon atom, but does not exclude the presence of other atoms or groups in a proportion insufficient to detract from the substantially hydrocarbon characteristics of the group. The hydrocarbyl group is preferably composed of only hydrogen and carbon atoms. Advantageously, the hydrocarbyl group is an aliphatic group, preferably alkyl or alkylene group, especially alkyl groups, which may be linear or branched. R is preferably an alkyl or alkylene group. R is preferably branched.

The hydrocarbyl phenol aldehyde condensate preferably has a weight average molecular weight (Mw) in the range of 600 to 4000, preferably 800 to 3500, more preferably 1000 to 2000, even more preferably 1200 to 1900, and most preferably 1400 to 1750, as measured by MALDI-TOF (Matrix Assisted Laser Desorption Ionization-Time of Flight) Mass Spectrometry.

The hydrocarbyl phenol aldehyde condensate is preferably one obtained by a condensation reaction between at least one aldehyde or ketone or reactive equivalent thereof and at least one hydrocarbyl phenol, in the presence of an acid catalyst such as, for example, an alkyl benzene sulphonic acid. The product is preferably subjected to stripping to remove any unreacted hydrocarbyl phenol, preferably to less than 5 mass %, more preferably to less than 3 mass %, even more preferably to less than 1 mass %, of unreacted hydrocarbyl phenol. Most preferably, the product includes less than 0.5 mass %, such as, for example, less than 0.1 mass % of unreacted hydrocarbyl phenol.

Although a basic catalyst can be used, an acid catalyst is preferred. The acid catalyst may be selected from a wide variety of acidic compounds such as, for example, phosphoric acid, sulphuric acid, sulphonic acid, oxalic acid and hydrochloric acid. The acid may also be present as a component of a solid material such as acid treated clay. The amount of catalyst used may vary from 0.05 to 10 mass % or more, such as for example 0.1 to 1 mass % of the total reaction mixture.

In particular, the hydrocarbyl phenol aldehyde condensate is preferably branched dodecyl phenol formaldehyde condensate, such as, for example, a tetrapropenyl tetramer phenol formaldehyde condensate.

The hydrocarbyl phenol aldehyde condensate is preferably present in the additive concentrate in an amount ranging from about 2 to 20 mass %, preferably from about 5 to 15 mass %, and more preferably from about 10 to 12 mass %, based on the mass of the concentrate.

Preferably, the organic friction modifier and hydrocarbyl phenol aldehyde condensate are present in amounts providing a ratio of mass % organic friction modifier to mass % hydrocarbyl phenol aldehyde condensate of from about 1:3 to about 1:7, more preferably from about 1:1.5 to about 1:3.5, most preferably from about 1:1 to about 1:2.5. Thus, a concentrate containing at least 3 mass % of the organic friction modifier preferably contains at a minimum of from about 9 to about 21 mass % of hydrocarbyl phenol aldehyde condensate.

Some, hydrocarbyl phenol aldehyde condensates are known to provide antioxidancy, and dispersancy (see, for example, U.S. Pat. No. 5,259,967 to Ripple). Therefore, when a hydrocarbyl phenol aldehyde condensate is used to stabilize the additive package, phenolic and/or aminic antioxidants commonly used to provide lubricating oil compositions with oxidation inhibition could possibly be used in reduced amounts, or even eliminated. Some hydrocarbyl phenol aldehyde condensates have also been found to provide inherent detergency and when a hydrocarbyl phenol aldehyde condensate is used to stabilize the additive package, the amount of metal detergent could possibly be reduced. Because the hydrocarbyl phenol aldehyde condensates are free of metal and can also be free of sulfur, any inherent detergency provides the compositions of the present invention with an additional important advantage, particularly when the additive packages are to be used for the formulation of the new generations of "Low SAPS" (Sulphated Ash, Phosphorus and Sulphur) lubricants.

To provide additive package stability in the presence of 3 mass % or more of the organic friction modifier, the hydrocarbyl phenol aldehyde condensate can be used in an amount providing a ratio of mass % basic metal complex to mass % hydrocarbyl phenol aldehyde condensate of from about 1:7 to about 23:1, preferably at least about 1:3 to about 6:1, more preferably from about 1:2 about 5:1.

In order for the concentrate to be oleaginous, the additives may be in solution in an oleaginous carrier or such a carrier may be provided separately or both. Examples of suitable carriers are oils of lubricating viscosity, such as described in detail hereinafter, and aliphatic, naphthenic and aromatic hydrocarbons.

The oil of lubricating viscosity, useful for making concentrates of the invention, or for making lubricating oil compositions from such concentrates, may be selected from natural (vegetable, animal or mineral) and synthetic lubricating oils and mixtures thereof. It may range in viscosity from light distillate mineral oils to heavy lubricating oils such as gas engine oil, mineral lubricating oil, motor vehicle oil, and heavy duty diesel oil. Generally, the viscosity of the oil ranges from 2 centistokes to 30 centistokes, especially 5 centistokes to 20 centistokes, at 100° C.

Natural oils include animal oils and vegetable oils (e.g., castor oil, lard oil); liquid petroleum oils and hydro-refined, solvent-treated or acid-treated mineral oils of the paraffinic, naphthenic and mixed paraffinic-naphthenic types. Oils of lubricating viscosity derived from coal or shale also serve as useful base oils.

Synthetic lubricating oils include hydrocarbon oils and halo-substituted hydrocarbon oils such as polymerized and interpolymerized olefins (e.g., polybutylenes, polypropylenes, propylene-isobutylene copolymers, chlorinated polybutylenes, poly(1-hexenes), poly(1-octenes), poly(1-decenes)); alkylbenzenes (e.g., dodecylbenzenes, tetradecylbenzenes, dinonylbenzenes, di(2-ethylhexyl)benzenes); polyphenyls (e.g., biphenyls, terphenyls, alkylated polyphenols); and alkylated diphenyl ethers and alkylated diphenyl sulfides and derivative, analogs and homologs thereof.

Alkylene oxide polymers and interpolymers and derivatives thereof where the terminal hydroxyl groups have been modified by esterification, etherification, etc., constitute another class of known synthetic lubricating oils. These are exemplified by polyoxyalkylene polymers prepared by polymerization of ethylene oxide or propylene oxide, and the alkyl and aryl ethers of polyoxyalkylene polymers (e.g., methyl-polyiso-propylene glycol ether having a molecular weight of 1000 or diphenyl ether of poly-ethylene glycol having a molecular weight of 1000 to 1500); and mono- and polycarboxylic esters thereof, for example, the acetic acid esters, mixed $C_3$-$C_8$ fatty acid esters and $C_{13}$ Oxo acid diester of tetraethylene glycol.

Another suitable class of synthetic lubricating oils comprises the esters of dicarboxylic acids (e.g., phthalic acid, succinic acid, alkyl succinic acids and alkenyl succinic acids, maleic acid, azelaic acid, suberic acid, sebasic acid, fumaric acid, adipic acid, linoleic acid dimer, malonic acid, alkylmalonic acids, alkenyl malonic acids) with a variety of alcohols (e.g., butyl alcohol, hexyl alcohol, dodecyl alcohol, 2-ethylhexyl alcohol, ethylene glycol, diethylene glycol monoether, propylene glycol). Examples of such esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebac ate, the 2-ethylhexyl diester of linoleic acid dimer, and the complex ester formed by reacting one mole of sebacic acid with two moles of tetraethylene glycol and two moles of 2-ethylhexanoic acid.

Esters useful as synthetic oils also include those made from $C_5$ to $C_{12}$ monocarboxylic acids and polyols and polyol esters such as neopentyl glycol, trimethylolpropane, pentaerythritol, dipentaerythritol and tripentaerythritol.

Silicon-based oils such as the polyalkyl-, polyaryl-, polyalkoxy- or polyaryloxysilicone oils and silicate oils comprise another useful class of synthetic lubricants; such oils include tetraethyl silicate, tetraisopropyl silicate, tetra-(2-ethylhexyl) silicate, tetra-(4-methyl-2-ethylhexyl)silicate, tetra-(p-tert-butyl-phenyl) silicate, hexa-(4-methyl-2-ethylhexyl)disiloxane, poly(methyl)siloxanes and poly(methylphenyl) siloxanes. Other synthetic lubricating oils include liquid esters of phosphorous-containing acids (e.g., tricresyl phosphate, trioctyl phosphate, diethyl ester of decylphosphonic acid) and polymeric tetrahydrofurans.

The oil of lubricating viscosity may comprise a Group I, Group II, Group III, Group IV or Group V oil or blends of the aforementioned oils. The oil of lubricating viscosity may also comprise a blend of a Group I oil and one or more of Group II, Group III, Group IV or Group V oil.

Definitions for the oils as used herein are the same as those found in the American Petroleum Institute (API) publication "Engine Oil Licensing and Certification System", Industry Services Department, Fourteenth Edition, December 1996, Addendum 1, December 1998. Said publication categorizes oils as follows:

a) Group I oils contain less than 90 percent saturates and/or greater than 0.03 percent sulfur and have a viscosity index greater than or equal to 80 and less than 120 using the test methods specified in Table 1.
b) Group II oils contain greater than or equal to 90 percent saturates and less than or equal to 0.03 percent sulfur and have a viscosity index greater than or equal to 80 and less than 120 using the test methods specified in Table 1. Although not a separate Group recognized by the API, Group II oils having a viscosity index greater than about 110 are often referred to as "Group II+" oils.
c) Group III oils contain greater than or equal to 90 percent saturates and less than or equal to 0.03 percent sulfur and have a viscosity index greater than or equal to 120 using the test methods specified in Table 1.
d) Group IV oils are polyalphaolefins (PAO).
e) Group V oils are all other base stocks not included in Group I, II, III, or IV.

TABLE 1

| Property | Test Method |
|---|---|
| Saturates | ASTM D2007 |
| Viscosity Index | ASTM D2270 |
| Sulfur | ASTM D4294 |

The oil of lubricating viscosity preferably has a saturate content of at least 65%, more preferably at least 75%, such as at least 85%. Most preferably, the oil of lubricating viscosity has a saturate content of greater than 90%. Preferably, the oil of lubricating viscosity has a sulfur content of less than 1%, preferably less than 0.6%, more preferably less than 0.3%, by mass, such as 0 to 0.3% by mass.

Preferably the volatility of the oil of lubricating viscosity, as measured by the Noack test (ASTM D5880), is less than or equal to about 40 mass %, such as less than or equal to about 35 mass %, preferably less than or equal to about 32 mass %, such as less than or equal to about 28 mass %, more preferably less than or equal to about 16 mass %. Preferably, the viscosity index (VI) of the oil of lubricating viscosity is at least 85, preferably at least 100, most preferably from about 105 to 140.

In addition to the overbased metal detergent, organic friction modifier and hydrocarbyl phenol aldehyde condensate, a concentrate of the present invention, and fully formulated lubricants formed therefrom, can contain a number of other performance improving additives selected from ashless dispersants, antiwear agents, oxidation inhibitors or antioxidants, metal-containing friction modifiers and fuel economy agents, antifoamants, corrosion inhibitors, and polyalkenyl acylating agent. Conventionally, when formulating a lubricant, the additives will be provided to the formulator in one or more, preferably a single concentrated additive package, oftentimes referred to as a DI (dispersant-inhibitor) package and a VI improver and/or VI improver and LOFI, will be provided in a second package.

Ashless dispersants maintain in suspension oil insolubles resulting from oxidation of the oil during wear or combustion. They are particularly advantageous for preventing the precipitation of sludge and the formation of varnish, particularly in gasoline engines.

Dihydrocarbyl dithiophosphate metal salts are frequently used as antiwear and antioxidant agents. The metal may be an alkali or alkaline earth metal, or aluminum, lead, tin, molybdenum, manganese, nickel or copper. The zinc salts are most commonly used in lubricating oil and may be prepared in accordance with known techniques by first forming a dihydrocarbyl dithiophosphoric acid (DDPA), usually by reaction of one or more alcohol or a phenol with $P_2S_5$ and then neutralizing the formed DDPA with a zinc compound. For example, a dithiophosphoric acid may be made by reacting mixtures of primary and secondary alcohols. Alternatively, multiple dithiophosphoric acids can be prepared where the hydrocarbyl groups on one are entirely secondary in character and the hydrocarbyl groups on the others are entirely primary in character. To make the zinc salt, any basic or neutral zinc compound could be used but the oxides, hydroxides and carbonates are most generally employed. Commercial additives frequently contain an excess of zinc due to the use of an excess of the basic zinc compound in the neutralization reaction.

Oxidation inhibitors or antioxidants reduce the tendency of mineral oils to deteriorate in service. Oxidative deterioration can be evidenced by sludge in the lubricant, varnish-like deposits on the metal surfaces, and by viscosity growth. Such oxidation inhibitors include hindered phenols, alkaline earth metal salts of alkylphenolthioesters having preferably $C_5$ to $C_{12}$ alkyl side chains, calcium nonylphenol sulfide, oil soluble phenates and sulfurized phenates, phosphosulfurized or sulfurized hydrocarbons, phosphorous esters, metal thiocarbamates, oil soluble copper compounds as described in U.S. Pat. No. 4,867,890, and molybdenum-containing compounds and aromatic amines.

Known metal-containing friction modifiers include oil-soluble organo-molybdenum compounds. Such organo-molybdenum friction modifiers also provide antioxidant and antiwear credits to a lubricating oil composition. As an example of such oil soluble organo-molybdenum compounds, there may be mentioned the dithiocarbamates, dithiophosphates, dithiophosphinates, xanthates, thioxanthates, sulfides, and the like, and mixtures thereof. Particularly preferred are molybdenum dithiocarbamates, dialkyldithiophosphates, alkyl xanthates and alkylthioxanthates.

Foam control can be provided by an antifoamant of the polysiloxane type, for example, silicone oil or polydimethyl siloxane.

Some of the above-mentioned additives can provide a multiplicity of effects; thus for example, a single additive may act as a dispersant-oxidation inhibitor. This approach is well known and need not be further elaborated herein.

Representative effective amounts of such additional additives, when used in fully formulated crankcase lubricants, are listed below in Table 2:

TABLE 2

| ADDITIVE | Mass % (Broad) | Mass % (Preferred) |
|---|---|---|
| Ashless Dispersant | 0.1-20 | 1-8 |
| Metal Detergents | 0.1-15 | 0.2-9 |
| Corrosion Inhibitor | 0-5 | 0-1.5 |
| Metal Dihydrocarbyl Dithiophosphate | 0.1-6 | 0.1-4 |
| Antioxidant | 0-5 | 0.01-2 |
| Pour Point Depressant | 0.01-5 | 0.01-1.5 |
| Antifoaming Agent | 0-5 | 0.001-0.15 |
| Supplemental Antiwear Agents | 0-1.0 | 0-0.5 |
| Friction Modifier | 0-5 | 0-1.5 |
| Basestock | Balance | Balance |

The concentrates of the invention are preferably prepared at an elevated temperature, i.e. above ambient temperature. Such concentrates may be prepared at a temperature of at least 50° C. such as at least 80° C., preferably at least 90° C., more preferably at least 100° C. Although energy is saved at low temperatures, practical considerations dictate the most convenient temperature that can be used. Thus, where an additive is used that is solid at ambient temperature it is usually more convenient to raise the temperature to a temperature at which the additive flows, rather than dissolving it in oil prior to addition to the other additives. Temperatures of 100° C. or more can be employed if any additive is more conveniently handled at such temperatures. Consideration must be given to the time for which it is held at the mixing temperature and its stability under such temperatures and time conditions.

Conventionally, when forming additive concentrates, the dispersant and detergent are pre-blended at a relatively high temperature, and the resulting pre-blend is then mixed with the remaining additives at a lower temperature. The blending sequence has not been found to have a significant impact on the effect of the hydrocarbyl phenol aldehyde condensate on concentrate stability. Therefore, the hydrocarbyl phenol aldehyde condensate can be pre-blended with the dispersant and detergent before being mixed with the remaining additives, including the organic friction modifier, may be mixed with other additives, including the organic friction modifier prior to contact with the dispersant/detergent pre-blend, or can be introduced into the concentrate, as a separate component at any stage during concentrate formation. The components of the concentrate are advantageously held at the mixing temperature for a time sufficient to achieve a homogenous mixture thereof. This can usually be accomplished within one half hour, particularly when the temperature of mixing exceeds 80° C.

The concentrates of the invention can be incorporated into a lubricating oil composition in any convenient way. Thus, they can be added directly to an oil of lubricating viscosity by dispersing or dissolving them in the oil at the desired concentrations of the dispersant and detergent, respectively. Such blending can occur at ambient temperature or elevated temperatures. Alternatively, the composite can be blended with a suitable oil-soluble solvent and base oil to form a further concentrate which is then blended with an oil of lubricating viscosity to obtain the final lubricating oil composition. Such concentrate will typically contain (on an active ingredient (A.I.) basis) from about 1.7 to about 20 mass %, preferably from about, preferably from about 3 to about 10 mass %, of the organic friction modifier containing at least one hydroxyl or amino group, and from about 3 to about 45 mass %, preferably from about 5 to about 30 mass %, more preferably from about 7.5 to about 25 mass % of the basic metal complex, and from about 1 to about 15 mass %, preferably from about 3 to about 13 mass %, more preferably from about 6 to about 8 mass % of the hydrocarbyl phenol aldehyde condensate, based on the total concentrate weight; the remainder of the concentrate comprising diluent (preferably no more than about 90 mass %, such as not more than 80 mass %) oil and, optionally, other additives.

This invention will be further understood by reference to the following examples, wherein all parts are parts by weight (AI), unless otherwise noted and which include preferred embodiments of the invention.

EXAMPLES

Synthesis Example A

Nonylphenol (10.5 mol) diluted in heptane was reacted with formaldehyde (9.0 mol) in water using a sulphonic acid catalyst. The reagents were charged to a 5 L flask and heated under nitrogen to 100° C. After addition of diluent oil, the water and heptane were distilled off until the temperature reached 150° C. The reaction mixture was then stripped under vacuum to remove residual solvent and yield a final product. The quantities of the reagents used are provided in Table 3.

TABLE 3

| Reagent | Mass (g) |
|---|---|
| nonylphenol | 2645 |
| Paraformaldehyde | 270.3 |
| Water | 661.7 |
| Heptane | 1000 |
| Sulfonic Acid Catalyst | 27.1 g |
| Total Reagent | 4604 |
| Diluent Oil | 1355.8 g |

The final product had a number average molecular weight (Mn) of about 840, a weight average molecular weight (Mw) of about 1260 and contained about 0.09 mass % residual nonylphenol, as determined by GPC and HPLC analysis.

Comparative Example 1

Conventional additive concentrates containing a 300 TBN calcium sulfonate detergent, a $C_8$ hindered phenol antioxidant (Irganox L135, trade name, a product of Ciba Specialty Chemicals Corporation) other conventional additives (dispersant, ZDDP, aminic antioxidant, molybdenum based antiwear agent, antifoamant), diluent oil and increasing amounts of organic friction modifiers (ethoxylated tallow amine (ETA) and glycerol monooleate (GMO)), were prepared as shown in Table 4 (amounts expressed in terms of mass %).

TABLE 4

| | Component | | | | |
|---|---|---|---|---|---|
| | C1 | C2 | C3 | C4 | C5 |
| Ca Sulf Det. | 17.8 | 17.8 | 17.8 | 17.8 | 17.8 |
| Irganox L135 | 8.9 | 8.9 | 8.9 | 8.9 | 8.9 |
| GMO | 0.0 | 1.1 | 1.7 | 2.2 | 3.3 |
| ETA | 1.7 | 1.7 | 1.7 | 1.7 | 1.7 |

TABLE 4-continued

| | Component | | | | |
|---|---|---|---|---|---|
| | C1 | C2 | C3 | C4 | C5 |
| Other Additives | 54.9 | 54.9 | 54.9 | 54.9 | 54.9 |
| Diluent | 16.8 | 15.7 | 15.1 | 14.5 | 13.4 |
| Total | 100.0 | 100.0 | 100.0 | 100.0 | 100.0 |

Inventive Example 1

Additive concentrates of the present invention, in which the methylene bridged alkyl phenol (MBAP) of Synthesis Example A was substituted for the Irganox L135 hindered phenol antioxidant were then prepared as shown in Table 5 (amounts are expressed in terms of mass %). The blending procedure and order were identical (preblending of dispersant and detergent at higher temperature, followed by mixing of detergent/dispersant preblend with other additives at lower temperature), to those used to form the concentrates of Comparative Example 1.

TABLE 5

| | Component | | | | | |
|---|---|---|---|---|---|---|
| | I1 | I2 | I3 | I4 | I5 | I6 |
| Ca Sulf Det. | 17.8 | 17.8 | 17.8 | 17.8 | 17.8 | 17.8 |
| Irganox L135 | 0.0 | 0.0 | 0.0 | 0.0 | 0.0 | 0.0 |
| MBAP | 5.6 | 5.6 | 5.6 | 11.1 | 11.1 | 11.1 |
| GMO | 0.0 | 1.7 | 3.3 | 0.0 | 1.7 | 3.3 |
| ETA | 1.7 | 1.7 | 1.7 | 1.7 | 1.7 | 1.7 |
| Other Additives | 54.9 | 54.9 | 54.9 | 54.9 | 54.9 | 54.9 |
| Diluent | 20.1 | 18.4 | 16.8 | 14.5 | 12.9 | 11.2 |
| Total | 100.0 | 100.0 | 100.0 | 100.0 | 100.0 | 100.0 |

Each of the above additive concentrates was then subjected to a storage stability test in which the concentrates were stored for a number of weeks at 60° C. with periodic measuring of the amount of sediment formed. A concentrate package failed the stability test at the time the amount of sediment measured was greater than 0.05%, based on the total weight of the concentrate. The results for the comcentrates of Comparative Example 1, containing the phenolic antioxidant are provided in Table 6. The results achieved with the concentrates of Inventive Example 1 are provided in Table 7.

TABLE 6

| | Conc. ID | | | | |
|---|---|---|---|---|---|
| Week # | C1 | C2 | C3 | C4 | C5 |
| 1 | Pass | Pass | Pass | Pass | Pass |
| 2 | Pass | Pass | Pass | Pass | Pass |
| 3 | Pass | Pass | Pass | Pass | Pass |
| 4 | Pass | Pass | Pass | Fail | Fail |
| 5 | Pass | Pass | Fail | | |
| 6 | Pass | Pass | | | |
| 7 | Pass | Fail | | | |
| 8 | Pass | | | | |

TABLE 7

| | Conc. ID | | | | | |
|---|---|---|---|---|---|---|
| Week # | I1 | I2 | I3 | I4 | I5 | I6 |
| 1 | Pass | Pass | Pass | Pass | Pass | Pass |
| 2 | Pass | Pass | Pass | Pass | Pass | Pass |
| 3 | Pass | Pass | Pass | Pass | Pass | Pass |
| 4 | Pass | Pass | Pass | Pass | Pass | Pass |
| 5 | Pass | Pass | Pass | Pass | Pass | Pass |
| 6 | Pass | Pass | Fail | Pass | Pass | Pass |
| 7 | Pass | Pass | | Pass | Pass | Fail |
| 8 | Pass | Pass | | Pass | Pass | |

As shown by the foregoing, in the concentrates containing 8.89 mass % of the phenolic antioxidant, the presence of 3.34 mass % total of organic friction modifier caused formation of an unacceptable level of sediment after only four weeks of storage. As the total amount of organic friction modifier increased to 3.88 mass % and 5 mass %, failure of the storage stability test occurred at only 5 weeks and 4 weeks, respectively. In contrast, in the presence of only 5.56 mass % of MBAP, concentrates containing a total of 3.34 mass % of organic friction modifier remained stable at the end of the eight week stability test, and the concentrate containing a total of 5 mass % of organic friction modifier remained stable for six weeks. Increasing the amount of MBAP to 11.11 mass % allowed concentrates containing a total of 5 mass % of organic friction modifier to remain stable through the end of the seventh week.

The disclosures of all patents, articles and other materials described herein are hereby incorporated, in their entirety, into this specification by reference. A description of a composition comprising, consisting of, or consisting essentially of multiple specified components, as presented herein and in the appended claims, should be construed to also encompass compositions made by admixing said multiple specified components. The principles, preferred embodiments and modes of operation of the present invention have been described in the foregoing specification. What applicants submit is their invention, however, is not to be construed as limited to the particular embodiments disclosed, since the disclosed embodiments are regarded as illustrative rather than limiting.

The invention claimed is:

1. A lubricating oil additive concentrate comprising an oil of lubricating viscosity, from about 3 to about 45 mass % of an overbased metal detergent, from about 2 mass % to about 20 mass % of an oil-soluble hydrocarbyl phenol aldehyde condensate of the formula

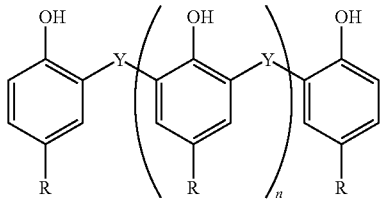

wherein n is 0 to 10; Y is a hydrocarbyl group having from 1 to 4 carbon atoms; and R is a hydrocarbyl group having from 4 to 30 carbon atoms, and at least 3 mass %, based on the total mass of said concentrate, of an organic friction modifier containing at least one hydroxyl or amino group selected from the group consisting of glycerol esters of higher fatty acids; esters of long chain polycarboxylic acids with diols; oxazoline compounds; alkoxylated alkyl-substituted mono-amines, diamines and alkyl ether amines; and mixtures thereof, wherein said organic friction modifier and said hydrocarbyl phenol aldehyde condensate are present in amounts providing a ratio of mass % organic friction modifier to mass % hydrocarbyl phenol aldehyde condensate of from about 1:3 to about 1:7 and said overbased metal detergent and said hydrocarbyl phenol aldehyde condensate are present in amounts providing a ratio of mass % basic metal complex to mass % hydrocarbyl phenol aldehyde condensate of from about 1:7 to about 23:1.

2. A concentrate according to claim 1, wherein n is 3 to 6; and R is a hydrocarbyl group having from 9 to 15 carbon atoms.

3. A concentrate according to in claim 1, comprising from about 10 mass % to about 12 mass % of said oil-soluble hydrocarbyl phenol aldehyde condensate, based on the total mass of said concentrate.

4. A concentrate according to claim 1, wherein said organic friction modifier is selected from the group consisting of glycerol oleates; ethoxylated amines; and mixtures thereof.

5. A concentrate according to claim 1, comprising at least 5 mass % of said organic friction modifier, based on the total mass of said concentrate.

6. A concentrate according to claim 1, wherein said overbased metal detergent is selected from the group consisting of overbased calcium sulfonates, overbased magnesium sulfonates, overbased calcium phenates, overbased magnesium phenates, overbased calcium carboxylates, overbased magnesium carboxylates, overbased calcium hybrid detergents containing surfactant systems comprising at least two of sulfonate, phenate and carboxylate surfactant, overbased magnesium hybrid detergents containing surfactant systems comprising at least two of sulfonate, phenate and carboxylate surfactant, and mixtures thereof.

7. A concentrate according to claim 6, wherein said overbased metal detergent is an overbased calcium detergent.

8. A concentrate according to claim 6, wherein said overbased metal detergent is an overbased metal sulfonate detergent, or an overbased metal hybrid detergent containing a surfactant system comprising sulfonate surfactant and at least one other surfactant.

9. A concentrate according to claim 6, wherein said overbased metal detergent is an overbased calcium sulfonate detergent, or an overbased calcium hybrid detergent containing a surfactant system comprising sulfonate surfactant and at least one other surfactant.

10. A concentrate according to claim 1, further comprising at least one other additive selected from the group consisting of dispersant, antioxidants and antiwear agents.

* * * * *